United States Patent [19]

Hill

[11] 4,031,988

[45] June 28, 1977

[54] STALL CONTROL AND WEAR BLOCK FOR RECREATIONAL SKATE BOARDS

[76] Inventor: David John Hill, 1/71 Evans St., Harbord N.S.W. 2096, Australia

[22] Filed: Apr. 28, 1976

[21] Appl. No.: 681,056

[30] Foreign Application Priority Data

Jan. 7, 1976 Australia ..... 4468/76

[52] U.S. Cl. ..... 188/250 B; 188/5; 188/251 A; 188/261; 280/11.2; 280/87.04 A

[51] Int. Cl.[2] ..... A63C 17/00

[58] Field of Search ..... 280/87.04 A, 87.04 R, 280/11.2; 188/5, 23, 73.1, 250 B, 251 A, 261, 250 R; 135/84, 77

[56] References Cited

UNITED STATES PATENTS

| | | | |
|---|---|---|---|
| 1,890,424 | 12/1932 | Whitworth | 188/251 A |
| 2,289,587 | 7/1942 | Marshall | 188/261 |
| 2,485,147 | 10/1949 | Fowlkes | 280/11.2 |
| 2,578,384 | 12/1951 | Wall | 280/11.2 |
| 2,941,812 | 6/1960 | Reynolds | 280/11.2 |
| 3,622,172 | 11/1971 | Goodwin | 280/11.2 |
| D200,917 | 4/1965 | Markham | 280/87.04 A |

FOREIGN PATENTS OR APPLICATIONS

| | | | |
|---|---|---|---|
| 1,225,922 | 9/1966 | Germany | 188/73.1 |
| 1,029,590 | 5/1966 | United Kingdom | 280/87.04 A |

*Primary Examiner*—Joseph F. Peters, Jr.
*Assistant Examiner*—David M. Mitchell
*Attorney, Agent, or Firm*—Edward C. Threedy

[57] ABSTRACT

One or both ends of a skateboard has its effective lower surface of the platform brought nearer to the ground than the remainder of the platform by the addition of a block or blocks which comes into contact with the ground when the rider elects to ride the skateboard on only one of the two sets of wheels. The existence and shaping of this block assists the rider to maneuver and control the board and avoids the wear of an irreplaceable part of the board. The block is moulded plate of suitable material attached to the underside of the board the major opposing sides of the plate being elliptical. For control purposes the shape over a 120° central sector of the major side is significant but for wear factor reasons it is extended to 160°. No part of the radius should be less than 15 mm, or more than 110 mm. and the contact periphery should have a rounded shoulder to provide a satisfactory area of initial contact. The unexposed face may have a grid of holes to assist cooling, trap melting material, and reduce weight, or they may be filled with inserts of harder material to resist wear.

3 Claims, 3 Drawing Figures

STALL CONTROL AND WEAR BLOCK FOR RECREATIONAL SKATE BOARDS

The invention relates to an accessory to be applied to recreational skateboards which generally speaking are platforms equipped with skate wheels, the platform being long enough for the user to stand on while the device is propelled either by one foot or by free-wheeling down an incline or by weight shifting. Users have developed an art of special manoeuvres and an added ability to secure special control of these movements is of value to the user. During use a skateboard is sometimes deliberately operated on one only of the two sets of wheels in which case one end of the skateboard will come in contact with the surface over which it is travelling and wear of an irreplaceable portion of the platform will occur. Wear blocks mounted on the undersurface of the platform will strengthen that member and prevent damage thereto both on collision and due to abrasive wear, and prevent the sharpening of the end of the platform to a dangerous chisel-like edge.

Wear blocks have been previously proposed and used made from the addition of wood blocks or in the form of thin metal plates. Such wear blocks may be used to brake the speed or halt the progress of the skateboard. In a series of tests designed to eliminate the uneven wear of wear blocks it has been discovered by the inventor that a particular shape of the edge of the block where it comes into contact with the ground will assist the control of what are known as "stalls" and "stall turns" and that a departure from that shape by a signifiicant amount will make these maneuvers much harder. The applicant has devised a moulded stall control and wear block with a particular configuration which while providing a superior form of wear block will also give improved control by the user. Areas of control and wear regions of this configuration are later defined.

Figure 1:
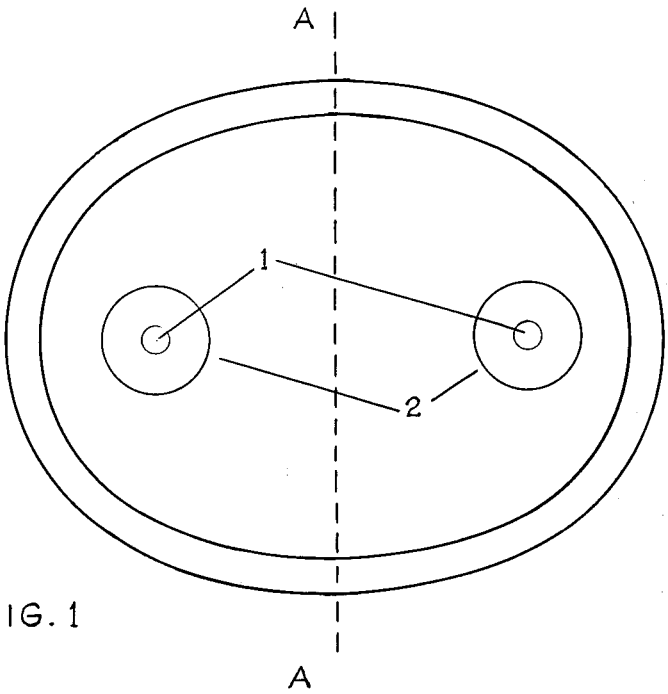
Figure 2:
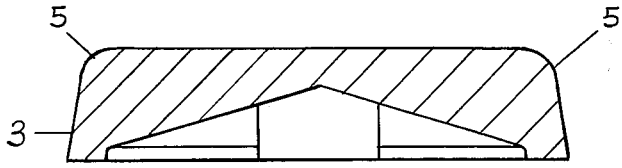
Figure 3:
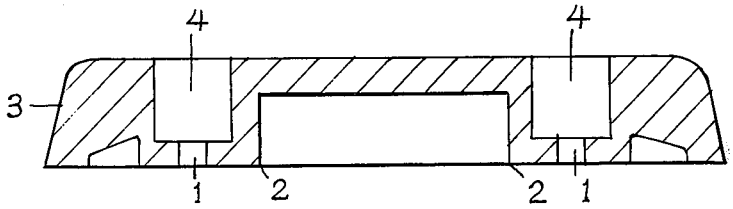

The invention will now be described by reference to the accompanying drawings in which FIG. 1 is a plan view from the side which will not contact the skating surface, FIG. 2 is a sectional end view at a point along the major axis of the block, and FIG. 3 is a sectional view at a point along the minor axis of the block.

The shape chosen embodies one which will give a more even wear characteristic, an ability to prolong the life of the block by rotation through 180° when one major side has been worn, and more particularly one which gives the rider an increased control. Subject to providing the special peripheral shape needed over the critical area it will be clear that an elliptical shape will be convenient but a truncation beyond the extremes of the wear area may be permissible and provided it does not extend into the control area the truncation may intrude to a limited degree into the wear area if shorter block life can be tolerated. Accordingly FIG. 1 shows the preferred shape but it may be modified over the non-critical portions of the periphery as already indicated. The requirements of the block are met by shaping the edge which will contact the ground in a fashion which will maintain a constant area and pressure between the wear block and the skating surface as the skateboard platform or deck is tilted to the right or the left, as is done in guiding the board through turns.

The plan shape may be defined as having a width over the major axis of not less than 60 mm. or more than 140 mm; and a width over the minor axis at right angles to the major axis of not less than 50 mm. or more than 110 mm; and a plan outline which consists of an oval or ellipse-like form (truncated if desired parallel to the line A—A at the ends of the major axis) no part of which has a radius of less than 15 mm. or more than 110 mm. The contact periphery 5, (shown in FIG. 2) should have a rounded shoulder to provide a satisfactory area of initial contact so that full control can be realised from the beginning without the need for a wearing-in period.

A functional plan outline approximating the shape so far described could be built up from a number of short straight sections, each being at a slight angle to the other. To cover such a contingency, any such straight section in the plan outline must not exceed 15 mm. in length.

The degree of control attainable in operating the skateboard is a function of the shape of the edge taken over approximately 60° either side of the centre of the major ellipse but to achieve a satisfactory wear factor the ellipse must extend to about 80° on either side of the mid-point. Such a shape is shown in FIG. 1 where A—A is a line through the center of the major ellipse about which the aforementioned areas of critical configuration fall. In the drawing, 1 indicates holes to secure the control and wear block to the underside of the skateboard while 2 indicates the boundary of the circular section of material surrounding the screw-hole which comes into contact with the skateboard. The symmetrical shape of the block permits a rotation through 180 degrees to allow the presentation of a new edge when that originally used has become too worn.

FIG. 2 shows a sectional end view of the wear block in which a bevel 3 around the periphery of the block will be apparent and which may range from 5° to 20° from the vertical. This is optional and is provided where it is desired to minimize the positional differences at the point of contact with the ground when the block is fitted to either flat bottomed skateboards or skateboards known as "kicktail skateboards" which have an upswept section behind the rear wheels.

FIG. 3 (in which similar reference numerals to those used above appear) also shows the optional bevel but it performs no practial function other than appearance at this point since relatively little wear occurs here and as previously mentioned truncation could be applied if desired. The apertures 4 permit the fixing screws to sink below the active surface of the block.

As the use of such a wear block lowers the clearance between the skateboard and the ground the thickness of the block which can be employed is limited. Usually it is found that the block may vary in thickness from 3 to 25 mm. and that thicknesses in excess of 25 mm. usually negate the control ability of the block.

Reference to FIGS. 2 and 3 will show a reduction in the thickness of certain areas of the block in order to save material. It is clearly desirable to use material which can be molded by mass production methods and it is necessary to use a material which has neither too high nor too low a coefficient of friction but at the same time resists abrasion. One material which is suitable is sold under the Trade Mark "Nylon" 66. Unduly weighty material should be avoided and resistance to wear is also desired. The construction of the block may be varied without impact on the special configuration of the edge by providing a network of "blind" holes in the solid material vertical to the major surface on the unexposed surface of the block. This would serve to lighten the weight and save material, provide more rapid cooling when the block material tends to melt due to the heat created by friction, and to provide repositories in which the block material may be trapped if it tends to melt. Such holes may also allow the insertion into these holes of harder materials in rod form of the variety which cannot be moulded to resist rapidity of wear when the surface of the block is worn down to the blind hole level.

Having thus described my invention, what I claim as new and desire to protect by Letters Patent is:

1. A stall control and wear block for skateboards including a platform, comprising a plate-like element formed from moldable material having a plan configuration with major opposing elliptical sides symmetric about a transverse axis, the opposing major elliptical sides containing a central sector of 160° which constitutes a wear edge of which the central 120° is a control edge, no part of the wear and control edges having a radius of less than 15 millimeters or more than 110 millimeters, and at least two countersunk holes formed on the transverse axis of said block adapted to receive connectors for the attachment of the block to the skateboard platform.

2. A stall control and wear block as defined in claim 1 having a rounded shoulder on that edge of the periphery which contacts the ground.

3. A stall control and wear block as claimed in claim 2 which has a network of blind holes on the unexposed surface normal to the exposed surface and which do not emerge on the exposed wear surface of the block.

* * * * *